US007779499B2

(12) United States Patent
Lecinq et al.

(10) Patent No.: US 7,779,499 B2
(45) **Date of Patent: *Aug. 24, 2010**

(54) METHOD FOR THE ASSEMBLY OF A STAY

(75) Inventors: Benoit Lecinq, Fontenay-Aux-Roses (FR); Sebastien Petit, Paris (FR); Francois Bignon, Lisbonne (PT); Jerome Stubler, Paris (FR)

(73) Assignee: Freyssinet International (STUP), Velizy Cedex (FR)

( * ) Notice: Subject to any disclaimer, the term of this patent is extended or adjusted under 35 U.S.C. 154(b) by 1204 days.

This patent is subject to a terminal disclaimer.

(21) Appl. No.: 10/920,513

(22) Filed: Aug. 18, 2004

(65) Prior Publication Data

US 2005/0055974 A1 Mar. 17, 2005

(30) Foreign Application Priority Data

Aug. 20, 2003 (FR) ..... 03 10059

(51) Int. Cl.
*E01D 11/00* (2006.01)
*E01D 11/04* (2006.01)

(52) U.S. Cl. ..... 14/22; 14/18; 14/19; 14/23; 52/223.13; 52/223.14; 242/410; 242/416; 242/417.2

(58) Field of Classification Search ..... 52/223.1, 52/223.6, 223.7, 223.8, 223.13, 223.14, 146–152; 14/18–22; 242/410, 416, 417.2
See application file for complete search history.

(56) References Cited

U.S. PATENT DOCUMENTS

| | | | | |
|---|---|---|---|---|
| 5,083,469 | A | 1/1992 | Percheron et al. | |
| 5,461,743 | A * | 10/1995 | Stubler et al. | 14/22 |
| 5,479,671 | A | 1/1996 | Stubler et al. | |
| 5,803,641 | A | 9/1998 | Nutzel | |

FOREIGN PATENT DOCUMENTS

| | | |
|---|---|---|
| JP | 16605/92 | 9/1987 |
| JP | 189213/95 | 7/1995 |

OTHER PUBLICATIONS

Patent Abstract of Japan vol. 1995, No. 10, Nov. 30, 1995; JP 07 189213 A abstract, figure, Jul. 28, 1995, Suzuki Akiyoshi.

* cited by examiner

*Primary Examiner*—Jeanette Chapman
(74) *Attorney, Agent, or Firm*—Banner & Witcoff, Ltd

(57) ABSTRACT

A method for assembly of a stay includes a series of steps that include connecting in the vicinity of an anchoring zone, a new group of N reinforcements to a shuttle located within the sheath of a stay to be installed. The shuttle is driven towards another anchoring zone by means of driving and guiding means. When the shuttle has arrived substantially in the vicinity of the anchoring zone, and as long as entangling is detected between the driving and guiding means in a portion contained substantially between the shuttle and the first anchoring zone, the shuttle is rotated about its main axis in the opposite direction to the said entangling. The group of N reinforcements is then separated from the shuttle. Each reinforcement of the group is tensioned between the anchoring zones. The preceding steps are repeated until the installation of the reinforcements is completed.

31 Claims, 7 Drawing Sheets

METHOD FOR THE ASSEMBLY OF A STAY

CROSS REFERENCE TO RELATED APPLICATION

This application is a utility application based on Patent Application No. FR 03 10059 entitled "Method for the Assembly of a Stay" filed Aug. 20, 2003 for which priority is claimed.

BACKGROUND OF THE INVENTION

The present invention relates to the installation of tensioned reinforcements, such as strands, within a sheath, for the production of a stay belonging to the suspension system of a civil engineering structure.

In a stayed suspension, one or more pylons support a structure, such as, for example, a bridge deck, by means of a set of stays following oblique paths between a pylon and the structure. A stay is a cable composed of a set of reinforcements tensioned between two end anchorages and generally surrounded by a sheath. These reinforcements are often metal strands. Where a stayed bridge is concerned, each reinforcement is anchored on a pylon and on the deck of the bridge which it participates in supporting.

European Patent 0 421 862 describes a method for the tensioning of the strands of a stay, which advantageously makes it possible to balance the tensions between the various strands, whilst at the same time using a single-strand jack which is much lighter and manipulatable (above all, on a pylon) than a collective jack. According to this method, a first strand is tensioned in order to form a reference strand. Each following strand is tensioned with the aid of the single-strand jack, until its tension has the same value as that of the reference strand. During this operation, the tension of the strands already anchored decreases somewhat at the same time as that of the new strand increases. This operating mode progressively ensures that the various strands of the stay will be tensioned to the same value.

For large-size structures, the stays used are typically of great length, which may amount to several hundred metres, and a high number of tensioned elementary reinforcements (strands or the like) must be provided in order to support the load.

Moreover, on stayed structures with a very wide span (greater than 500 metres), the drag force on the sheet of stays predominates over the action of the wind on the deck and can lead to overdimensioning of the pylons. As the drag is proportional to the diameter of the sheath, it is therefore desirable to provide stays with a reduced-diameter sheath, that is to say more compact stays.

A difficult compromise must therefore be found between the number of strands per stay, which it is desirable to maximize in order to increase the supporting capacity of the stay, and its diameter, which it is desirable to minimize for aerodynamic reasons.

It is generally necessary, then, to provide space in the sheath in order to cause reinforcements to circulate during the installation of the stay. To be precise, the stays of large bridges are very heavy, so that it is not conceivable to hoist them after they have been prefabricated on the deck or on a prefabrication zone. In general, the sheath is put in place along the oblique path of the stay, and then the strands are installed one by one or small group by small group, by hoisting them with the aid of a shuttle sliding in the sheath and driven by a winch located on the pylon. During the hoisting of the last strand (or of the last group), sufficient space must remain in the sheath to allow the shuttle to pass. It is clearly desirable to minimize this residual space with a view to reaching the above compromise.

In EP-A-0 654 562, this problem was bypassed, in that the sheath consists of a plurality of shells assembled around a bundle of strands after the tensioning of these, thus making it possible to leave only a minimal space. However, for the general design of the stay, it is definitely preferable to provide a sheath in one piece, rather than in a plurality of parts. This, in particular, affords better protection with reinforcements against environmental attacks.

Moreover, it is necessary to ensure that the strands installed in the sheath are in parallel. This is carried out, in particular, by positioning the strands in a paired manner in the top and bottom anchorages by means of a numbering of the anchoring holes. But, there is a risk that a shuttle would tend to rotate on itself during hoisting, thus causing the hoisted strands to be entangled with one another and with the small cables used for ensuring the displacement of the shuttle between the anchoring zones. This applies particularly when the cross section of the shuttle used is smaller than that of the hoisted group of strands. This situation therefore necessitates the use of relatively bulky shuttles, thus making necessary, furthermore, to reserve a corresponding space in the sheath to allow the passage of such shuttles.

An object of the present invention is to provide a satisfactory solution to the problem set out above.

SUMMARY OF THE INVENTION

The invention thus proposes a method for the assembly of a stay comprising an inclined sheath and a bundle of substantially parallel tensioned reinforcements housed in the sheath and individually anchored in a first and a second anchoring zone, the reinforcements being put in place in groups of N reinforcements, N being a number equal to or greater than 1, in which a sheath and some of the reinforcements are installed. The method subsequently comprises the following steps:

/a/ connecting, in the vicinity of the second anchoring zone, a new group of N reinforcements to a shuttle located inside the sheath;

/b/ driving the shuttle towards the first anchoring zone by means of driving and guiding means;

/c/ when the shuttle has arrived substantially in the vicinity of the first anchoring zone, and as long as entangling between the driving and guiding means is detected in a portion contained substantially between the shuttle and the first anchoring zone, rotating the shuttle about its main axis in the opposite direction to the said entangling;

/d/ separating the group of N reinforcements from the shuttle;

/e/ tensioning each reinforcement of the group between the first and second anchoring zones; and /f/ repeating steps /a/ to /e/ until the installation of the reinforcements is completed.

The entangling generally occurring during the drive of the shuttle and taking the form of twists formed between the driving and guiding means is thus displaced into the vicinity of the first anchoring zone where it can then easily be detected. The detection involves, for example, counting the twists present between the driving and guiding means in the portion contained between the shuttle and the first anchoring zone. Straightness and parallelism of these driving and guiding means are then restored by rotating the shuttle on itself, thus making it possible to apply an opposite and compensating twist to the driving and guiding means. The corresponding twists which occurred between the reinforcements of the new group to be installed, in the portion contained between the shuttle and the second anchoring zone, are then eliminated concomitantly, thus restoring the parallelism of these reinforcements with one another and with the reinforcements already installed.

According to embodiments of the invention which may be combined with one another in any way:

the driving and guiding means comprise at least one guide wire tensioned at least between the first and second anchoring zones, and a first small cable connected to the shuffle and to a hoisting winch, step /c/ comprising the detection of entangling between that part of the guide wire which extends substantially between the shuttle and the first anchoring zone and the first small cable;

the driving and guiding means comprise at least two guide wires tensioned at least between the first and second anchoring zones, step /c/ comprising the detection of entangling between the guide wires over their part extending substantially between the shuttle and the first anchoring zone;

the said some of the reinforcements are reinstalled, with substantially uniform tension values being applied to the reinforcements, step /e/ comprising the tensioning of each reinforcement of the new group of N reinforcements between the first and second anchoring zones, in such a way that the whole of the installed reinforcements has substantially uniform tension values;

before the shuffle is driven towards the first anchoring zone, the already installed reinforcements are compacted at least one end of the sheath, the shuffle being located in a space left available by the compacted reinforcements;

the shuttle has a cross section smaller than a cross section of the new group of N reinforcements;

the drive of the shuttle towards the first anchoring zone comprises a sliding of the shuttle on at least one guide wire;

a second small cable extending in the direction of the second anchoring zone is connected to the shuttle and to a lowering winch, the drive of the shuttle towards the first anchoring zone being braked by a stress of the second small cable in the opposite direction by the lowering winch;

after the new group of N reinforcements has been separated from the shuttle, the shuttle is relowered by actuating the lowering winch, whilst a hoisting winch is controlled so as to stress a first small cable in the opposite direction, the shuttle sliding on a guide wire during the relowering;

when the shuttle has been relowered until it arrives substantially in the vicinity of the second anchoring zone, and as long as entangling is detected between that part of the guide wire which extends substantially between the shuttle and the second anchoring zone and the second small cable, the shuttle is rotated about its main axis in the opposite direction to the said entangling, before steps /a/ to /e/ are repeated;

the shuttle is attached to at least two guide wires during its drive towards the first anchoring zone, each guide wire looping on itself, part of the loop being formed outside the sheath; after the new group of N reinforcements has been separated from the shuttle, the shuttle is relowered by actuating motor means designed to drive the guide wires from the first towards the second anchoring zone, in the loop part extending within the sheath between the said first and second anchoring zones;

the motor means are actuated, furthermore, when the shuttle is driven towards the first anchoring zone, in order to brake the drive of the shuttle by means of a stress in the opposite direction;

the loop formed by each guide wire follows a path established by a system of pulleys comprising means for adjusting the length of a portion of the loop extending between the first and second anchoring zones, as a function of a length of the stay to be assembled;

a portion of the part of the loop which is formed outside the sheath extends within a sheath of a second stay symmetrical to the current stay with respect to a longitudinal plane of symmetry;

when the shuttle has been relowered until it arrives substantially in the vicinity of the second anchoring zone, and as long as entangling is detected between the guide wires in their part extending substantially between the shuttle and the second anchoring zone, the shuttle is rotated about its main axis in the opposite direction to the said entangling, before steps /a/ to /e/ are repeated;

the shuttle is attached to at least two guide wires, each guide wire looping on itself, a part of the loop being formed outside the sheath; the shuttle is driven towards the first anchoring zone by means of motor means designed to drive the guide wires from the second towards the first anchoring zone, in the loop part extending within the sheath between the said first and second anchoring zones;

the motor means are designed to drive the guide wires solely from the second towards the first anchoring zone, in the loop part extending within the sheath between the said first and second anchoring zones;

the motor means are designed to drive the guide wires from the second towards the first anchoring zone or from the first towards the second anchoring zone, in the loop part extending within the sheath between the said first and second anchoring zones, after the group of N reinforcements has been separated from the shuffle, the shuffle is relowered by actuating the motor means in order to drive the guide wires from the first towards the second anchoring zone, in the loop part extending within the sheath between the said first and second anchoring zones;

each reinforcement consists of a strand comprising a central wire and a plurality of peripheral wires stranded around the central wire; for the execution of step /a/, the peripheral wires are severed in an end portion of each reinforcement of the new group and the central wire is connected to the shuttle in the end portion;

the connection of a new group of N reinforcements to the shuttle comprises the fastening of the central wire of each reinforcement of the new group to a corresponding coupler, each coupler being maintained in contact with the shuttle during step /b/;

the couplers are designed in such a way that the assembly consisting of the shuttle and of the said couplers has a minimal cross section;

the shuttle comprises two portions capable of being coupled to one another, longitudinal holes being arranged between the two portions of the shuttle for the respective passage of the central wires of the reinforcements of the new group of N reinforcements, the couplers being located respectively opposite the longitudinal holes for the respective passage of the corresponding central wires;

the separation of the new group of N reinforcements from the shuttle comprises an uncoupling of the two portions of the shuttle;

each coupler is connected to a small cable actuated by an auxiliary winch located substantially in the region of the first anchoring zone, in order to complete a drive of the new group as far as the first anchoring zone when the shuttle is not driven as far as said first anchoring zone.

DESCRIPTION OF PREFERRED EMBODIMENTS

Figure 1:
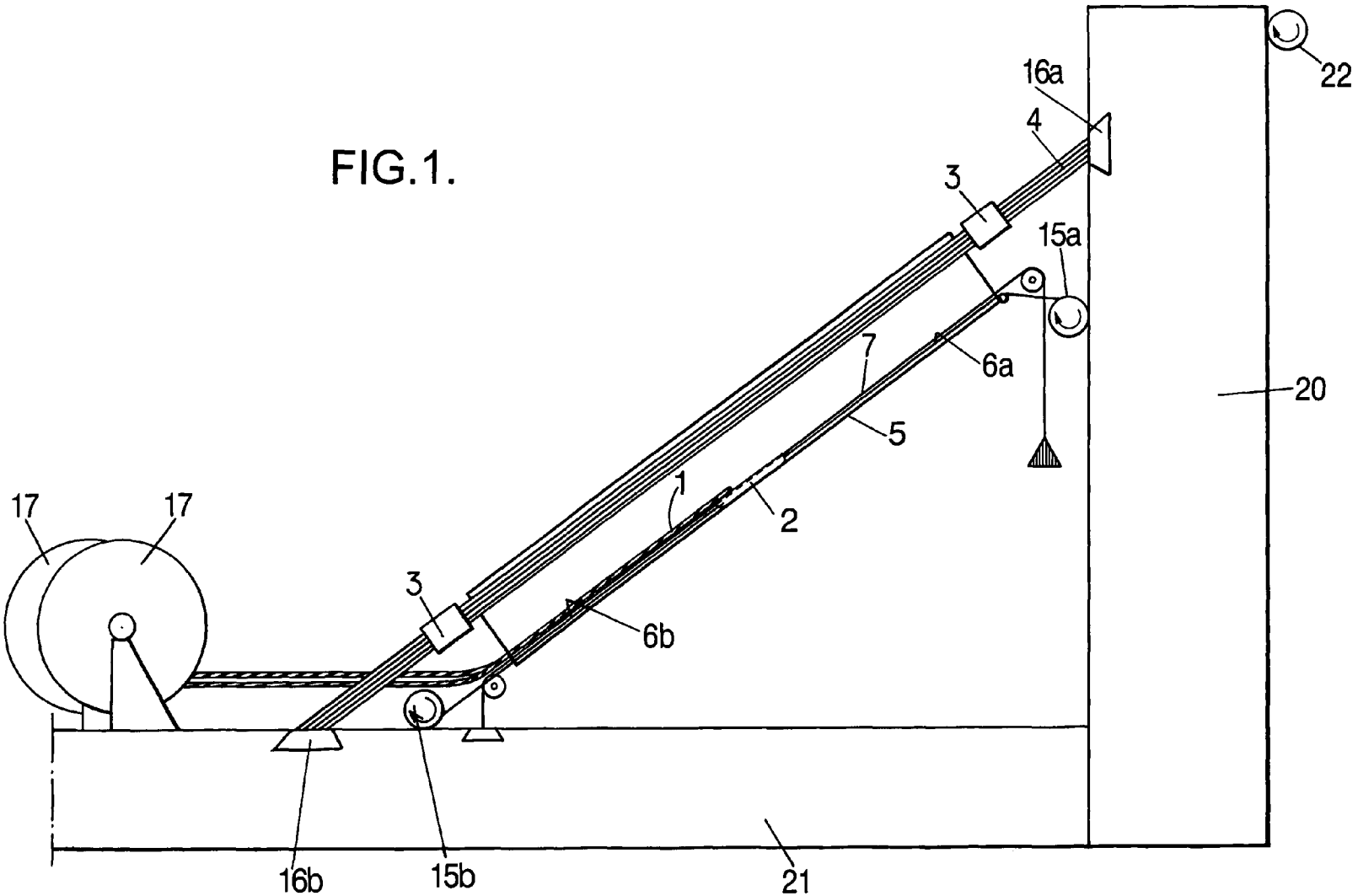
FIG. 1 is a simplified diagram showing a first mode of installation of a stay on a bridge according to the invention.

The invention is used particularly in the field of stayed bridges. What is considered here is a stay contained in a sheath 5 and extending between a pylon 20 and the deck 21 (FIG. 1). The stay under consideration may be of great length, for example of a length greater than 100 metres. It may comprise a potentially high number of elementary reinforcements, of the order of about fifty or more.

The reinforcements of the stay consist of strands 4 grouped in the form of a bundle housed in the sheath 5. Each strand is tensioned and anchored at its two ends in two anchoring zones 16*a*, 16*b* located respectively on the pylon 20 and on the deck 21. The anchoring means located in the zones 16*a*, 16*b* may be of conventional type, for example with an anchoring block bearing on the structure and equipped with frustoconical orifices for receiving frustoconical jaws wedged around each strand.

In a first step of the method for assembling the stay, the sheath is put in place along its oblique path between the two anchoring zones, at the same time as a first strand or as a first set of strands tensioned and anchored at their two ends. The sheath 5, from then on, rests on the strand or strands already installed. During this first step, a movable appliance described below, which comprises a shuttle 2, is likewise placed in the sheath 5.

The first strands 4 to be installed do not generally present any problem in being put in place, in as much as the space available within the sheath 5 is sufficient for the strands to be easily inserted in the latter. These strands are delivered from reels 17 placed on the deck of the bridge or from a place for the storage of the strands when these have previously been precut. They are then threaded into the sheath, for example by hoisting them from the deck 21 towards the pylon 20.

In order to prevent the strands already installed from being entangled, these are positioned in such a way that they are substantially parallel to one another over their entire length. For this purpose, each strand is placed in corresponding positions on the two anchoring blocks. This may be carried out by symmetrically numbering the frustoconical orifices having corresponding positions in the blocks located in the zones 16*a*, 16*b* and by introducing each strand into orifices of the same number on either side.

Before anchoring, each strand threaded into the sheath is tensioned, preferably in such a way that the various strands already tensioned have uniform tension values, for example according to the method described in European Patent 0 421 862. Since the strands are of identical construction and are anchored in corresponding geometrical positions on the two blocks, this makes it possible to impart quasi-parallel paths to the various strands between the two anchoring zones.

The space occupied by the strands within the sheath can therefore remain restricted, including in the central part of the sheath where access is difficult. Since the sheath bears on the installed strands, the lower part of its cross section remains available for the insertion of the following strands.

However, after a little while, the introduction of new strands into the sheath 5 becomes difficult, since the space available in the sheath is reduced. In order to increase this space, there may advantageously be provision for compacting the already anchored strands 4 in order to compress them together along their path. The shuttle 2 to which the new strand 1 or the new group of strands to be threaded is attached (FIG. 1) is then placed in the available space left at the bottom of the sheath 5.

The compacting of the strands already installed is carried out at least one end of the sheath 5 by means of a compacting system 3. The identical conditions for the tensioning of these strands ensure that this local compacting is propagated over the entire length of the stay, thus maximizing the space available for the travel of the shuttle 2. To reinforce this effect, it is expedient to provide the compacting system 3 at each end of the sheath 5, as shown in FIG. 1.

Figure 2:
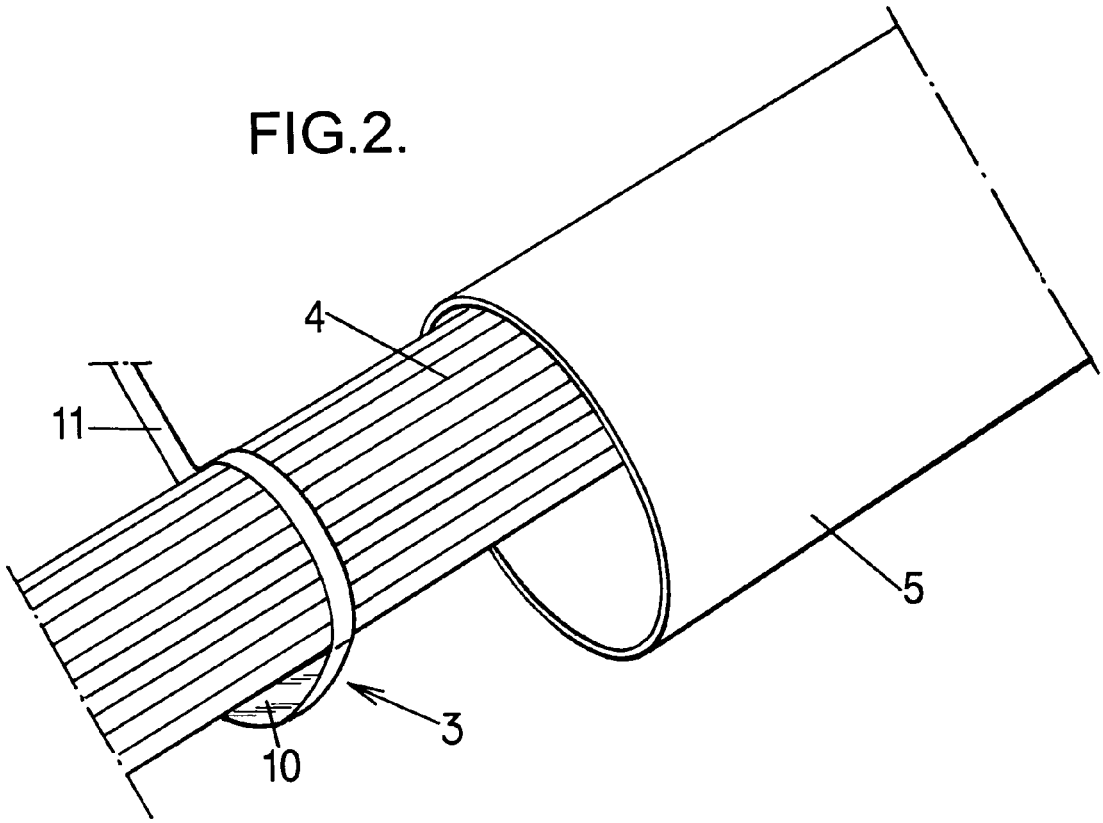
FIG. 2 is a diagram illustrating a mode of compacting of already installed reinforcements.

As illustrated in FIG. 2, the system 3 advantageously compacts the already installed reinforcements 4 according to a template, the cross section of which has an upper portion of substantially circular general shape, the diameter of this circular shape being equal to the inside diameter of the sheath or approximate to this. The sheath 5 then rests on the bundle of compacted strands, losing the minimum amount of space in the upper part and therefore releasing the maximum amount of space in the lower part of the sheath in order to make it easier for the shuttle 2 to travel.

In the example illustrated in FIG. 2, the compacting system 3 comprises a strap 11 for girdling the bundle of strands, with a wedge 10 being interposed. The wedge 10 defines the lower portion of the cross section of the compacting template.

According to the invention, the shuttle 2 follows one or more guide wires tensioned between the anchorages 16*a* and 16*b*. If the guide wire used is fixed, for example if it is anchored on the deck 21 of the bridge and tensioned by means of a mass suspended on a pulley supporting the guide wire and located near the pylon 20 of the bridge (see FIG. 1), the shuttle will then slide along this guide wire during its travel between the anchoring zones 16*a* and 16*b*. If, on the contrary, the guide wire is movable between the anchoring zones, the shuttle 2 will then be attached to the guide wire in order to follow its movement. The guide wires used are advantageously high-strength steel wires with a diameter of the order of, for example, 2 mm.

Before a new strand 1 or, preferably to improve the performance of the installation, a new group of strands 1 is hoisted from the deck 21 towards the pylon 20 of the bridge, this strand or this group of strands is connected to the shuffle 2.

In a first embodiment illustrated in FIG. 1, the hoisting of the new group of strands 1 is carried out by means of the pull of the shuttle 2 with the aid of a small cable 6*a* connected to the shuttle 2 and pulled by the hoisting winch 15*a* located on the pylon 20. The shuttle 2 slides on the guide wire 7 tensioned between the anchoring zones. Symmetrically, another small cable 6*b* can be connected to the shuttle 2 and extend downwards as far as a lowering winch 15*b*. This winch 15*b* is activated in order to relower the shuttle 2, once the new strand or the new group of strands hoisted has been separated from the said shuttle.

Advantageously, during the hoisting of the new strand 1 by the winch 15*a*, the lowering winch 15*b* is also activated in order to stress the small cable 6*b* and the shuttle in the opposite direction. Likewise, during the return of the shuttle 2 by the winch 15*b*, the hoisting winch 15*a* is also activated in order to stress the small cable 6*a* and the shuttle in the opposite direction. These arrangements mean that the shuttle/small-cable assembly is always under tension during the displacements of a shuttle at the bottom of a sheath 5, thus ensuring a uniform path of this assembly along the sheath.

As will be described below, the shuttle 2 has small dimensions, so as to be capable of being displaced in the sheath 5, even when the space left available in the sheath by the already installed strands is restricted. Such a shuttle thus makes it possible to assemble stays of small diameter, but comprising a high number of strands, since the space lost in the sheath is reduced to the greatest possible extent. Advantageously, the shuttle 2 has a cross section smaller than the cross section of the group of strands 1 to be installed.

Such a small shuttle, because of its small dimensions and low weight in particular, cannot avoid rotating on itself when it is hoisted in the sheath 5, especially because of the twisting forces stored in the strands which it carries. This movement generates entangling, that is to say twists, between the strands 1 of the group, on the one hand, and between the strands 1 and the small cables 6*a* and 6*b*, on the other hand. Furthermore, since the shuttle 2 follows at least one guide wire in the sheath, the entangling also involves these guide wires. In particular, in the embodiment described above, the entangling will take place between the guide wire 7 and the small cable 6*a*, the small cable 6*b* and the strands 1. The entangling consists of a certain number of twists which occur between the various elements mentioned above.

When the strands 1 to be installed are entangled in this way, they cannot be tensioned for the purpose of being anchored, as such, in the anchoring zones 16*a* and 16*b*, since the parallelism sought between the strands installed in the stay would not otherwise be adhered to. It is therefore necessary to eliminate the entangling of these strands before they are finally installed.

In the embodiment illustrated in FIG. 1, when the shuttle 2 rotates on itself when it is being hoisted by means of the small cable 6*a* with the aid of a hoisting winch 15*a*, this gives rise, in particular, to entangling between the small cable 6*a* and the guide wire 7 on which the shuttle 2 slides. This entangling therefore takes place in the high portion of the guide wire 7 which extends between the shuttle 2 and the pylon 20 (upstream part).

Once the shuttle 2 has arrived at the top of the sheath 5, that is to say in the vicinity of the anchoring zone 16*a*, the entangling which exists between the small cable 6*a* and the guide wire 7 can be detected. For this purpose, for example, the number of twists present between the small cable 6*a* and the guide wire 7 and also their orientation are counted. This detection is easy, since the whole of the twists formed during the hoisting of the shuttle 2 has been displaced as far as the exit of the sheath. The entangling is therefore visible over a small length at the exit of the sheath 5.

The detected entangling is then eliminated by the shuttle being rotated, if appropriate manually, on itself about its main axis in the opposite direction to the detected entangling, that is to say in the opposite direction to the orientation of the detected twists. The number of turns to be executed equal to the number of twists detected.

In fact, the number of twists between the small cable 6*a* and the guide wire 7 is equal to that which exists in the strands 1 with one another and with the small cable 6*b* and also with that portion of the guide wire 7 which extends between the shuttle 2 and the bottom anchorage 16*b* (downstream part). Thus, the above described operation of disentangling the twists detected in the upstream part between the small cable 6*a* and the guide wire 7 makes it possible likewise to eliminate the entangling present in the downstream part, in particular between the strands 1. This mechanism thus makes it possible to recover a parallelism over the hoisted strands with one another and with the already installed strands 4, before they are tensioned and anchored on the pylon 20.

After being disentangled, the hoisted strands are separated from the shuttle 2, so as to be tensioned between the anchoring zones 16*a* and 16*b* and anchored according to the method explained above, in order to ensure an equal tension for all the installed strands as their installation progresses.

In this embodiment, once the separation of the shuttle and of the hoisted strands has been carried out, the shuttle can advantageously be relowered in a way approximately similar to its hoisting, for the purpose of using it for hoisting a new group of strands 1, as long as all the strands of the guide to be assembled have not been installed. Thus, the shuttle 2 is driven towards the deck 21 of the bridge as a result of the joint action of the small cable 6*b* and of the lowering winch 15*b*. During this return, the shuttle once again rotates on itself, thus generating entangling in the downstream part between the guide wire 7 and the small cable 6*b*.

The entangling is detected at the exit of the sheath 5, when the shuttle 2 has arrived in the vicinity of the anchoring zone 16*b*. Disentangling is then carried out, in order to restore parallelism between the guide wire 7 and the small cable 6*b*, but also, concomitantly, between the guide wire 7 and the small cable 6*a*. As before, this disentangling involves rotating the shuttle on itself about its main axis, as long as twists are detected at the exit of the sheath 5 between the guide wire 7 and the small cable 6*b*. This operation is repeated as long as entangling is detected between the guide wire 7 and the small cable 6*b*, that is to say a number of times equal to the number of twists detected, and in an opposite direction to the orientation of the twists. The device is then operational in order to make it possible to install a new strand 1 or a new group of strands 1.

Figure 3:
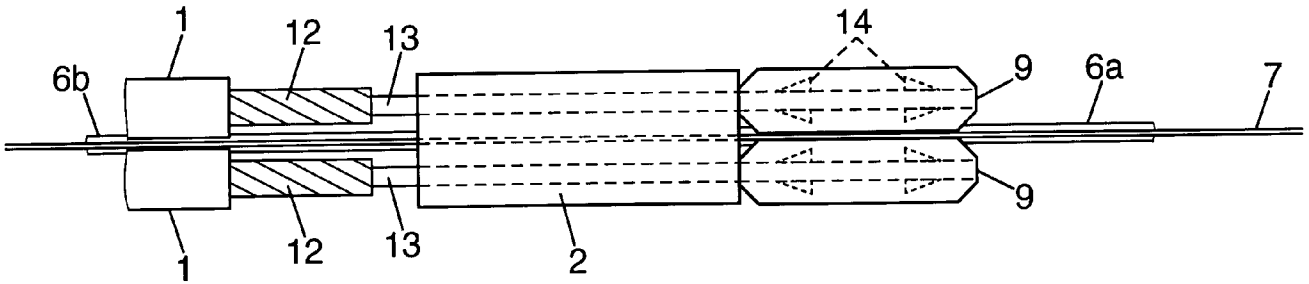
FIG. 3 is a diagram showing a movable appliance for the hoisting of strands.

FIG. 3 shows an example of the movable appliance making it possible to hoist a new group advantageously comprising two strands 1. The strands 1 are sheathed, as can be seen at the left-hand end of FIG. 3. The end portion 12 of the strands is stripped. Moreover, the strands each consist of six peripheral wires stranded around a central wire 13, as can be seen from the cross section of FIG. 4. At the end of each stripped strand 1, the six peripheral wires are severed so as to keep only the central wire 13. It is therefore only the central wires 13 which are connected to the shuttle 2. This arrangement makes it possible to reduce the cross section of the shuttle 2 considerably.

Figure 5:
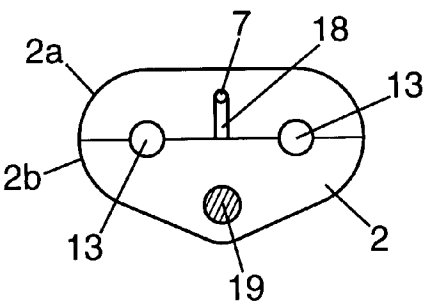
FIG. 5 is a cross section showing a shuttle structure suitable for the installation of strands according to the invention.

In an advantageous embodiment, the central wires 13 of the strands 1 are simply introduced into longitudinal holes 13 provided for this purpose in the shuttle 2, as illustrated in FIG. 5. Preferably individual couplers 9 are positioned at the exit of the shuttle in order each to receive the end of a central wire 13 of a strand 1. Each central wire 1 is fastened to the corresponding coupler 9, for example by means of two opposed keys 14. The couplers 9 thus prevent the strands 1 from emerging from the shuttle 2. When the shuttle is hoisted by means of the small cable 6*a* and the winch 15*a*, the couplers are maintained in contact with the said shuttle, thus ensuring the hoisting of the strands 1.

Moreover, in the example illustrated, the guide wire 7 is positioned so as to be housed within the upper curved triangle between the two strands 1. In this way, it does not occupy any space beyond the group of strands. Furthermore, a groove 18 is provided in the shuttle 2 (see FIG. 5), in order to receive the guide wire and to allow the shuttle 2 to slide along this wire.

Moreover, the small cables 6*a* and 6*b* are connected to the shuttle 2. A hole 19 can therefore be provided in the shuffle in order to receive the end of each of the two small cables on either side. This hole 19 is itself positioned so as to occupy a minimum amount of space in the cross section of the assembly consisting of the group of strands 1 and of the shuttle 2, the cross section of which must advantageously itself be minimal. It comprises, furthermore, locking screws (not illustrated) for anchoring the small winch cables in the shuttle.

Advantageously, the shuttle 2 is composed of two separate portions 2*a* and 2*b* which can be coupled to one another, for example by interlocking. An uncoupling of the two portions is likewise possible. In this case, the holes 13 are advantageously formed between the two portions of the shuttle. Likewise, the groove 18 can then issue onto the parting plane between the two portions of the shuttle. The groove 18 can also issue onto the upper part of the shuttle 2: it is then covered during the travel of the shuttle, in order to prevent the guide wire 7 from escaping from the latter.

Figure 4:
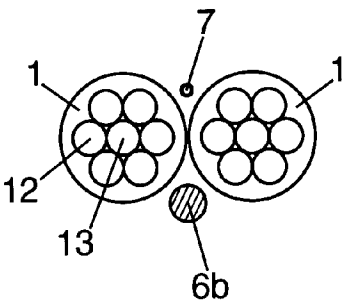
FIG. 4 is a cross section showing a movable appliance for the hoisting of strands.

According to the embodiment of the invention illustrated in FIG. 1, and with the arrangement of the movable appliance illustrated in FIGS. 3 to 5, it is possible to complete the travel of the strands 1 to be installed as far as the top anchorage 16*a*, on the assumption that the hoisting winch 15*a* has not already brought the movable appliance as near as possible to this anchorage. In this case, when the shuttle/coupler assembly has arrived at the end of the travel permitted by the hoisting winch 15*a*, each coupler 9 is advantageously connected to a small hoisting cable passing through the hole of the anchorage 16*a*, where the corresponding strand is to be anchored, and connected to an auxiliary hoisting winch 22. This auxiliary device then makes it possible to bring each strand as far as its anchorage.

The connection between a coupler and the associated small hoisting cable is preferably made before the separation between the hoisted strands 1 and the shuttle 2 for safety reasons. Subsequently, separation is carried out by means of a simple uncoupling of the portions 2*a* and 2*b* of the shuttle. Once the strands 1 are separated from the shuttle, it will be expedient, where appropriate, to couple the two portions of the shuttle once again, care being taken to reintroduce the guide wire 7 into the groove 18 of the shuttle 2, for the purpose of relowering the latter towards the deck 21 of the bridge.

Figure 6:
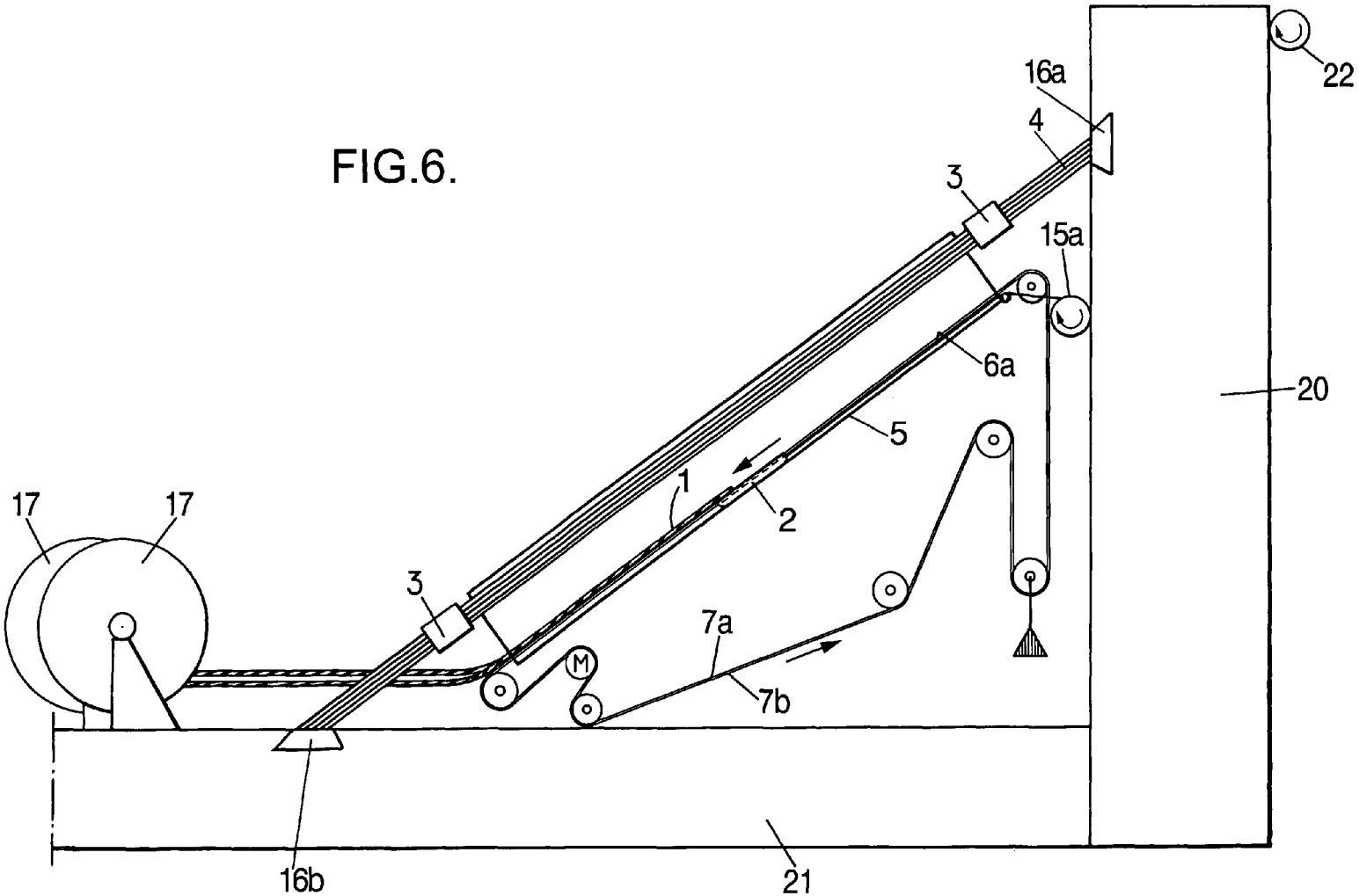
FIG. 6 is a simplified diagram showing a second mode of installation of a stay on a bridge according to the invention.

FIG. 6 shows an embodiment of the invention which is alternative to that illustrated in FIG. 1. In this second embodiment, the lowering winch 15*b* has been dispensed with. Furthermore, two guide wires 7*a* and 7*b* are used. These guide wires each form a loop, the connection point of which may advantageously occur in the region of the shuttle, by means of a crimped sleeve 23 surrounding the connected ends of the corresponding guide wire. The loops follow a path which is partially continued outside the sheath 5 of the stay. This path is defined by a system of pulleys illustrated in the figure. Moreover, motor means M located near the deck 21 in FIG. 6 make it possible to drive the guide wires 7*a* and 7*b* in the direction illustrated by the arrows (that is to say, from the anchoring zone 16*a* to the anchoring zone 16*b* when a position is taken up in the region of the sheath 5) and, where appropriate, in the other direction.

Advantageously, the pulleys used have a number of grooves equal to the number of guide wires to which the shuttle 2 is attached, that is to say two in the present example. They may likewise comprise a system for adjusting the length of the guide wires. Such an adjusting system is illustrated in FIG. 6 in the right-hand part of the loops executed by the guide wires 7*a* and 7*b*: two pulleys are fastened in the vicinity of the pylon 20 at heights approximate to one another. A third pulley, which is movable, deflects the guide wires downwards. A mass is suspended on this third pulley in order to maintain the tension of the guide wires. When a new stay having a length greater than that of the preceding stay is to be assembled, the guide wires used must be longer so as to extend between the anchoring zones 16*a* and 16*b*. The adjusting system will then modify the distance separating the movable pulley from the two fixed pulleys on the pylon 20, in such a way that the guide wires remain tensioned, whilst at the same time covering the entire length of the sheath of the new stay. Typically, if the new stay is located above the preceding one, the movable pulley will approach the fixed pulleys: this decrease in distance allows an increase in the length of the guide wires which is adapted to the length of the new stay.

Figure 7:
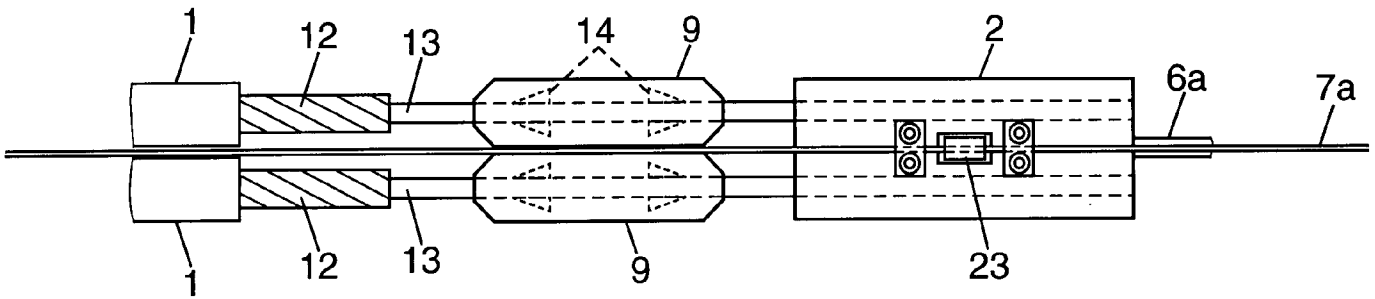
FIG. 7 is a diagram showing a movable appliance for the hoisting of strands; which is compatible with the second mode of installation of a stay.
Figure 10:
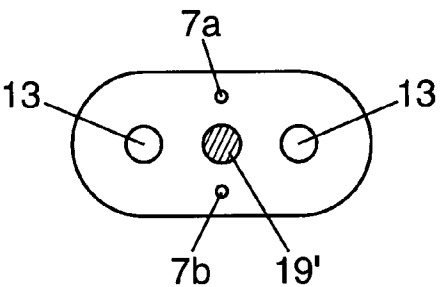
FIG. 10 is a view from a shuttle suitable for the installation of strands according to the second mode of installation of a stay.
Figure 9:
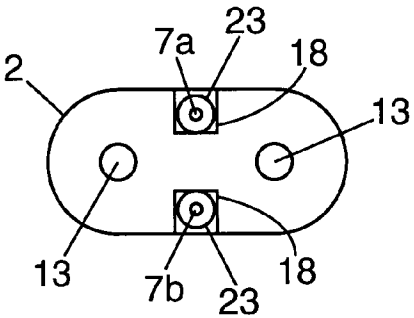
FIG. 9 is a cross section showing a shuttle structure suitable for the installation of strands according to the second mode of installation of a stay.
Figure 8:
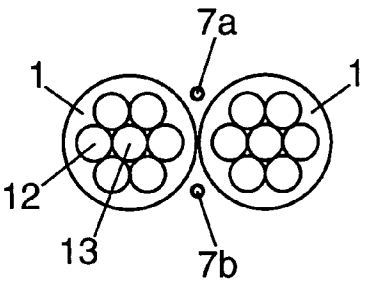
FIG. 8 is a cross section showing a movable appliance for the hoisting of strands which is compatible with the second mode of installation of a stay.

The shuffle 2 is attached to the guide wires 7*a* and 7*b*, which means that, contrary to the first embodiment, it follows their movement without sliding on them. For this purpose, the guide wires could, for example, be inserted into grooves of a shuffle 2, without the possibility of emerging from it without action by an operator. This insertion may be carried out, for example, in the region of the crimped sleeve 23 of each guide wire, as is illustrated in FIGS. 7 and 9. However, the cross section of the shuttle remains small and similar to the preceding case, as illustrated in FIGS. 9 and 10. To be precise, the small cable 6*a* can be connected to the shuttle 2 on its upstream face, for example being introduced into a hole 19' located at the centre of the face, thus avoiding needlessly increasing the size of the shuffle in its periphery. As regards the guide wires 7*a* and 7*b*, these are placed, for example, so as to pass between the strands 1, as indicated in FIGS. 8-10, again in order to limit the cross section of the shuttle.

Figure 12:
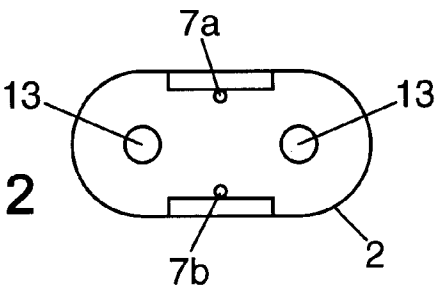
FIG. 12 is a cross section showing a shuttle structure suitable for the installation of strands according to the second mode of installation of a stay.

The small cable 6*a* may likewise be connected to one of the two couplers 9. In this case, the couplers 9 are preferably placed upstream of the shuttle during the hoisting of the assembly, and the shuttle may then be of the type illustrated in FIG. 12.

In this second embodiment, the hoisting of the shuttle carrying a new group of strands 1 takes place in the same way as in the first embodiment: a small cable 6*a* connected to a hoisting winch 15*a* makes it possible to drive the shuttle 2 towards the top anchorage 16*a*. The turns executed by the shuttle about itself during its hoisting result in entangling of the hoisted strands 1 with one another, on the one hand, and with the guide wires 7*a* and 7*b* and also the bundle of strands 4 possibly already installed, but also in a corresponding entangling between the guide wires 7*a* and 7*b* with one another and with the small cable 6*a*. The parallelism between the strands 1 which have just been hoisted and the bundle of already installed strands 4 is then restored by means of a detection of the entangling of the guide wires with the small cable 6*a* and then by a disentangling of the assembly in the vicinity of the top anchorage 16*a*. As in the preceding case, the disentangling involves, for each discovered twist formed between the guide wires and the small cable 6*a*, rotating the shuttle 2 in the opposite direction to the twist, until there is no longer any entangling discovered between the guide wires and the small cable.

Of course, the movable appliance composed of the shuttle 2 and of couplers associated with each new strand of the group to be installed, as illustrated in FIG. 7, may advantageously be used, during the hoisting of the strands according to this second embodiment, in order to make it possible to hoist the strands as far as their anchoring point with the aid of a small cable connected to an auxiliary winch 22. It will be seen that, in the example illustrated in FIG. 7, the strands 1 must be held firmly in the shuttle 2, since the latter is located upstream of the couplers 9. A shuttle structure consisting of two interlockable and uncouplable portions may likewise be envisaged, especially when the small cable 6*a* is connected to one of the couplers 9.

In the second embodiment of the invention, a small cable connected to a lowering winch is unavailable. The relowering of the shuttle 2 towards the deck 21 is therefore ensured by other means. In this particular case, the shuttle is advantageously relowered as a result of the action of the motor means M on the guide wires which they drive in the direction illustrated in FIG. 6. To be precise, the shuttle 2 is attached to the guide wires 7*a* and 7*b* in the example illustrated. The setting in motion of the loops formed by the guide wires by the motor means M thus ensures that the shuttle is driven from the pylon 20 as far as the deck 21, where it can be recovered in order to be used during a subsequent hoisting of strands.

During this relowering, the shuttle 2 once again risks rotating on itself, thus generating entangling between the small cable 6*a*, which advantageously serves for retaining the shuttle in this phase, and the guide wires 7*a* and 7*b*. In order to restore the straightness of these elements, entangling between the guide wires 7*a* and 7*b* is detected when the shuttle has reached the exit of the sheath 5 in the vicinity of the deck 21. A disentangling of these guide wires is carried out by rotating the shuttle 2 on itself a number of times equal to the number of twists detected between the guide wires 7*a* and 7*b* and in an opposite direction to the orientation of the twists. This disentangling moves about the symmetrical disentangling of the entangling formed between the guide wires and the small cable 6*a* in that part of the guide wires which extends between the shuttle 2 and the hoisting winch 15*a* (upstream part).

The use of at least two guide wires is therefore essential in this embodiment, since a single guide wire would not have made it possible to detect entangling in the upstream part between this guide wire and the small hoisting cable 6*a*. To be precise, this guide wire would have undergone twists on itself in its downstream part during the lowering of the shuttle, which are much more difficult to detect than a winding between two separate wires.

Figure 11:
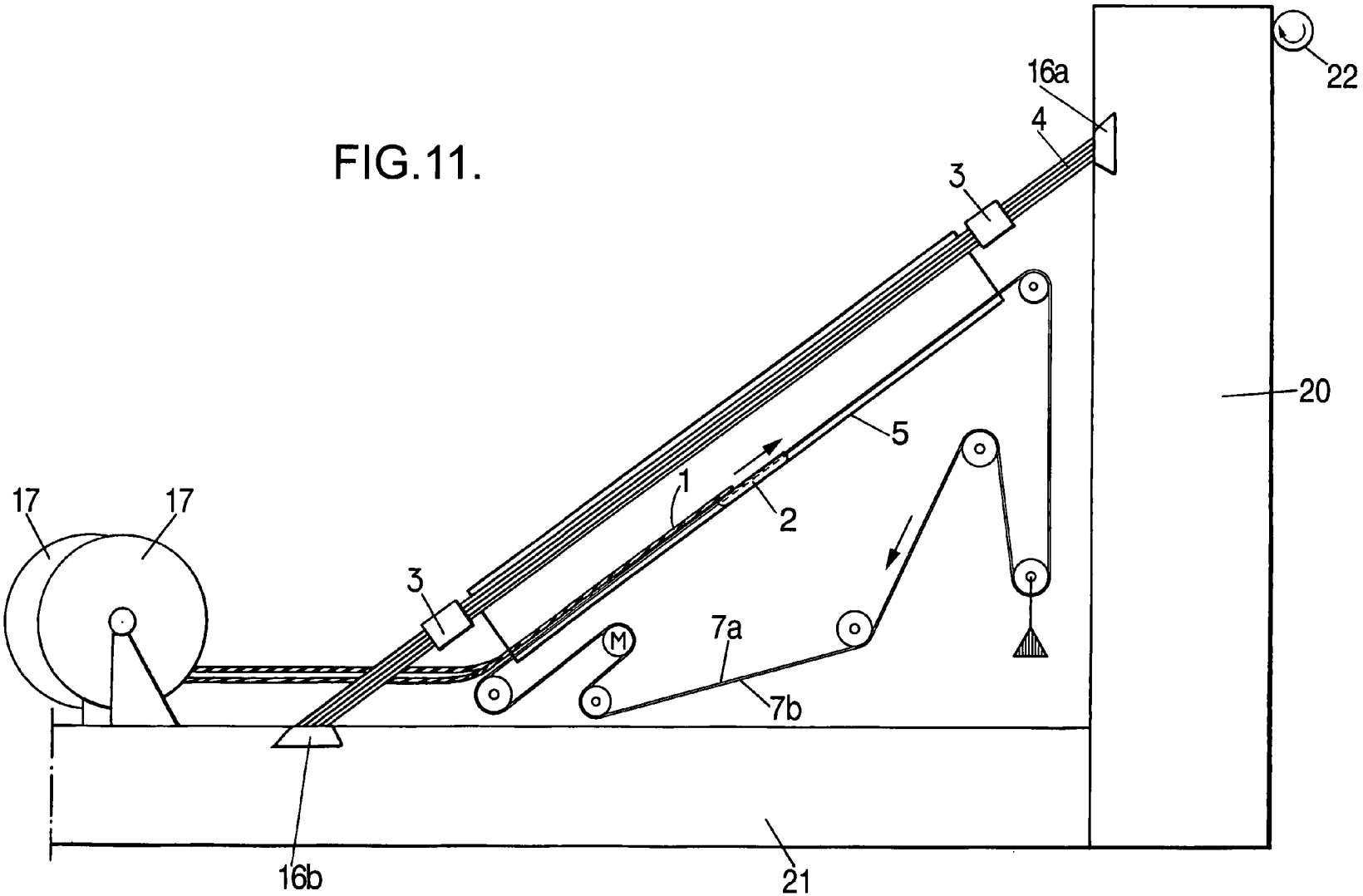
FIG. 11 is a simplified diagram showing a third mode of installation of a stay on a bridge according to the invention.

According to a third embodiment illustrated in FIG. 11, a small cable is no longer available either for hoisting a new group of strands 1 or for a relowering of the shuffle 2. As in the second embodiment, the shuttle 2 is attached to two guide wires 7*a* and 7*b*. The latter must be sufficiently robust to allow a pull on the shuttle during the hoisting of the new group of strands 1. The diameter of the guide wires is therefore slightly increased in this case.

As in the preceding case, the guide wires are looped and follow a path established by a set of pulleys comprising, if appropriate, a system for adjusting the length of the guide wires which is contained within the sheath 5 of the stay to be installed.

In the third embodiment, motor means M are designed to drive the guide wires 7*a* and 7*b* in the direction illustrated by the arrows of FIG. 11, that is to say from the deck 21 towards the pylon 20, if a position is taken up in the region of the loop portion located in the sheath 5, and, if appropriate, in the other direction.

The hoisting of the new group of strands is therefore carried out by an activation of the motor means, causing the guide wires and therefore the shuttle 2, which is temporarily integral with the guide wires, to be driven towards the pylon 20. The entangling associated with the twists of the shuttle on itself during the rise is detected at the exit of the sheath 5 by observing the twists formed between the two guide wires 7*a* and 7*b*. The disentangling of these twists by rotating the shuttle on itself in an opposite direction to the twists a number of times equal to the number of twists brings about the symmetrical disentangling of the hoisted strands 1 in the downstream part.

The structure of the shuttle 2 is slightly different from the preceding cases, since no space has to be reserved in it for receiving small hoisting or lowering cables. By contrast, sufficient housings must be provided in the shuttle for introducing the guide wires and the crimped sleeve 23 which, if appropriate, surrounds the latter. A shuttle structure in the form of two interlockable and uncouplable portions is likewise advantageous.

Of course, it is possible to use, in addition to the shuttle 2, individual couplers for each new hoisted strand 1, as was described above. These couplers advantageously serve for completing the travel of the strands as far as their anchoring point, in association with a small cable of relatively small length connected to an auxiliary hoisting winch 22.

In this third embodiment, it is possible to choose not to relower the shuttle within the sheath 5 after each hoisting. In this case, the motor means M always drive the guide wires 7*a* and 7*b* in the same direction, illustrated by the arrows in FIG. 11. The hoisting of the following strands will then be carried out by means of other shuttles. The need to use a high number of shuttles is nevertheless broadly compensated by the time saving in the installation of the stay, since there is no shuttle relowering phase which then slows down this installation.

However, it is likewise possible to relower the shuttle 2 in the sheath 5 by reversing the direction of drive of the guide wires by the motor means. In this case, a disentangling of the guide wires 7*a* and 7*b* from one another can then be carried out at the bottom of the sheath 5, as in the second embodiment of the invention described above.

According to a useful implementation of the second and the third embodiments of the invention, the parts of the loops formed by the guide wires 7*a* and 7*b* outside the sheath 5 are utilized in order to participate in the assembly of another stay.

Figure 13:
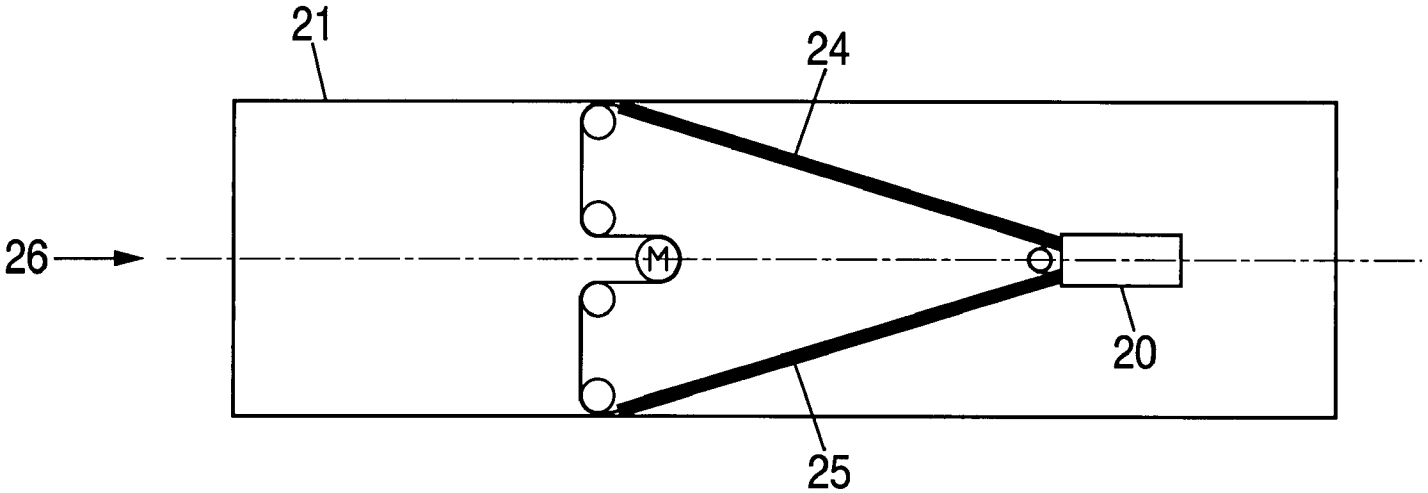
FIG. 13 is a simplified top view showing a mode of installation of a plurality of stays virtually simultaneously according to the invention.

This implementation, illustrated in FIG. 13, is especially advantageous with regard to a bridge on which stays are installed symmetrically on the two edges of the deck 21 from the same pylon 20. It makes it possible to install simultaneously two stays 24 and 25 which are symmetrical with respect to a longitudinal plane of symmetry represented by the longitudinal axis 26 of the deck which passes through the pylon of the bridge.

Thus, the guide wires are introduced into the respective sheaths of the two symmetrical stays and are each looped on themselves. As an illustration, within the framework of the third embodiment of the invention, when the guide wires 7*a* and 7*b* are driven from the deck 21 towards the pylon 20, thus causing the hoisting of a shuffle attached to these guide wires, within the sheath of a first stay 24, the same guide wires are driven from the pylon 20 to the deck 21, thus causing the lowering of another shuttle attached to these guide wires and located within the sheath of the stay 25 symmetrical to the first stay. Conversely, during the relowering of the shuttle in the sheath of the first stay 24, the shuttle located in the sheath of the stay 25 symmetrical to the first stay is driven towards the top anchorage. As regards the operations of disentangling the guide wires, these are carried out, as described above, with the following constraint: disentangling is carried out near the pylon for the first stay 24 simultaneously with disentangling carried out near the deck of the bridge for the stay 25 symmetrical to the first stay.

Such a synchronization of the operations in the two symmetrical stays thus makes it possible to install the strands in these two stays quasi-simultaneously, which represents a considerable time-saving in the installation of the stays of such a bridge.

The invention claimed is:

1. Method for the assembly of a stay comprising an inclined sheath and a bundle of substantially parallel tensioned reinforcements housed in the sheath and individually anchored in a first and a second anchoring zone, the reinforcements being installed in groups of N reinforcements, N being a number equal to or greater than 1, in which the sheath and some of the reinforcements are installed, comprising the steps of:

/a/ connecting, in the vicinity of the one of said first and second anchoring zones, a group of N reinforcements to a shuttle locatable inside the sheath;

/b/ driving the shuttle towards the other of said first and second anchoring zones by means of driving and guiding means;

/$c_1$/ when the shuttle has arrived substantially in the vicinity of the other anchoring zone, detecting entanglement between the driving and guiding means in a portion contained substantially between the shuttle and the other anchoring zone;

/$c_2$/ while the shuttle is substantially in the vicinity of the other anchoring zone, rotating the shuttle about its main axis in the opposite direction to the said entanglement in response to said detecting;

/d/ separating the group of N reinforcements from the shuttle; and

/e/ tensioning each reinforcement of the group between the anchoring zones.

2. Method according to claim 1, including the further steps of repeating steps /a/ to /e/ until the installation of reinforcements is completed.

3. Method according to claim 1, in which the driving and guiding means comprise at least one guide wire tensioned at least between the anchoring zones, and a first small cable connected to the shuttle and to a hoisting winch, and in which step /c/ comprises the detection of entanglement between that part of the guide wire which extends substantially between the shuttle and the other zone and the first small cable.

4. Method according to claim 1, in which the driving and guiding means comprise at least two guide wires tensioned at least between the anchoring zones, and in which step /c/ comprises the detection of entanglement between the guide wires over their part extending substantially between the shuttle and the other zone.

5. Method according to claim 1, in which the said some of the reinforcements are installed, with substantially uniform tension values being applied to the reinforcements, and in which step /e/ comprises the tensioning of each reinforcement of the group of N reinforcements between the anchoring zones, in such a way that the whole of the installed reinforcements has substantially uniform tension values.

6. Method according to claim 1, in which, before the shuffle is driven towards the other zone, the already installed reinforcements are compacted at least at one end of the sheath, and in which the shuttle is located in a space left available by the compacted reinforcements.

7. Method according to claim 1, in which the shuttle has a cross section smaller than a cross section of the new group of N reinforcements.

8. Method according to claim 1, in which the drive of the shuttle towards the other zone comprises a sliding of the shuttle on at least one guide wire.

9. Method according to claim 3, in which a second small cable extending in the direction of the one zone is connected to the shuttle and to a lowering winch, and in which the drive of the shuttle towards the other zone is braked by a stress of the second small cable in the opposite direction by the lowering winch.

10. Method according to claim 9, in which, after the new group of N reinforcements has been separated from the shuttle, the shuffle is relowered by actuating the lowering winch, whilst a hoisting winch is controlled so as to stress a first small cable in the opposite direction, the shuttle sliding on a guide wire during the relowering.

11. Method according to claim 10, in which, when the shuttle has been relowered until it arrives substantially in the vicinity of the one anchoring zone, and as long as entanglement is detected between that part of the guide wire which extends substantially between the shuttle and the one zone and the second small cable, the shuttle is rotated about its main axis in the opposite direction to the said entanglement.

12. Method according to claim 1, in which each reinforcement consists of a strand comprising a central wire and a plurality of peripheral wires stranded around the central wire, and in which, for the execution of step /a/, the peripheral wires are severed in an end portion of each reinforcement of the new group and the central wire is connected to the shuttle in the end portion.

13. Method according to claim 12, in which the connection of a new group of N reinforcements to the shuttle comprises the fastening of the central wire of each reinforcement of the new group to a corresponding coupler, each coupler being maintained in contact with the shuttle during step /b/.

14. Method according to claim 13, in which the couplers are designed in such a way that the assembly consisting of the shuffle and of the said couplers has a minimal cross section.

15. Method according to claim 13, in which the shuttle comprises two portions capable of being coupled to another, longitudinal holes being arranged between two portions of the shuttle for the respective passage of the central wires of the reinforcements of the new group of N reinforcements, and in which are located respectively opposite the respective passage of the holes for the central wires.

16. Method according to claim 15, in which the separation of the new group of N reinforcements from the shuttle comprises an uncoupling of the two portions the shuffle.

17. Method according to claim 13, in which each coupler is connected to a small cable actuated by an auxiliary winch located substantially in the region of the other anchoring zone, in order to complete a drive of the new group as far as the other anchoring zone when the shuttle is not driven as far as said other anchoring zone.

18. The method of claim 12, wherein said wires are disentangled and steps /a/ through /e/ are subsequently performed.

19. The method of claim 1, wherein said wires are disentangled and steps /a/ through /e/ are subsequently performed.

20. Method for the assembly of a stay comprising an inclined sheath and a bundle of substantially parallel tensioned reinforcements housed in the sheath and individually anchored in a first and a second anchoring zone, the reinforcements being installed in groups of N reinforcements, N being a number equal to or greater than 1, in which the sheath and some of the reinforcements are installed, comprising the steps of:

/a/ connecting, in the vicinity of the one of said first and second anchoring zones, a group of N reinforcements to a shuffle having a main axis and locatable inside the sheath;

/b/ driving the shuttle towards the other of said first and second anchoring zones by means of driving and guiding means resulting in entanglement of the driving and guiding means due to rotation of the shuttle about the main axis;

/c/ counter-rotating the shuttle about the main axis in the opposite direction to entanglement of the driving and guiding means due to rotation to thereby disentangle the driving and guiding means;

/d/ separating the group of N reinforcements from the shuttle; and

/e/ tensioning each reinforcement of the group between the first and second anchoring zones.

21. Method according to claim 1, in which the shuttle is attached to at least two guide wires during its drive towards the other zone, each guide wire looping on itself, part of the loop being formed outside the sheath, and in which, after the new group of N reinforcements has been separated from the shuttle, the shuttle is relowered by actuating the motor means designed to drive the guide wires from the other one zone, in the loop part extending within the sheath between the said anchoring zones.

22. Method according to claim 21, in which the motor means are actuated, furthermore, when the shuttle is driven towards the other zone, in order to brake the drive of the shuttle by means of a stress in the opposite direction.

23. Method according to claim 21, in which the loop formed by each guide wire follows a path established by a system of pulleys comprising means for adjusting the length of a portion of the loop extending between the anchoring zones, as a function of a length of the stay to be assembled.

24. Method according to claim 21, in which a portion of the part of the loop which is formed outside the sheath extends within a sheath of a second stay symmetrical to the current stay with respect to a longitudinal plane of symmetry.

25. Method according to claim 21, in which, when the shuttle has been relowered until it arrives substantially in the vicinity of the one zone, and as long as entangling is detected between the guide wires in their part extending substantially between the shuttle and the one zone, the shuttle is rotated about its main axis in the opposite direction to the said entangling.

26. Method according to claim 1, in which the shuttle is attached to at least two guide wires, each guide wire looping on itself, a part of the loop being formed outside the sheath, and in which the shuttle is driven towards the other zone by means of motor means designed to drive the guide wires from the one towards the other zone, in the loop part extending within the sheath between the anchoring zones.

27. Method according to claim 26, in which the motor means are designed to drive the guide wires solely from the second towards the other zone, in the loop part extending within the sheath between the said anchoring zones.

28. Method according to claim 26, in which the motor means are designed to drive the guide wires from one zone towards another zone, in the loop part extending within the sheath between the anchoring zones, and in which, after the group of N reinforcements has been separated from the shuttle, the shuttle is relowered by actuating the motor means in order to drive the guide wires from the other towards the one anchoring zone, in the loop part extending within the sheath between the said anchoring zones.

29. Method according to claim 28, in which, when the shuttle has been relowered until it arrives substantially in the vicinity of the one anchoring zone, and as long as there is entangling between the guide wires in their part extending substantially between the shuttle and the one anchoring zone, the shuttle is rotated about its main axis in the opposite direction to the said entangling.

30. Method according to claim 26, in which the loop formed by each guide wire follows a path established by a system of pulleys comprising means for adjusting the length of a portion of the loop extending between the anchoring zones, as a function of a length of the stay to be assembled.

31. Method according to claim 26, in which a portion of the part of the loop which is formed outside the sheath extends within a sheath of a second stay symmetrical to the current stay with respect to a longitudinal plane of symmetry.

* * * * *